United States Patent [19]

Klein

[11] 4,180,900

[45] Jan. 1, 1980

[54] APPARATUS FOR MAKING A COMMUTATOR FOR AN ELECTRIC MOTOR

[75] Inventor: Otto Klein, Wemding, Fed. Rep. of Germany

[73] Assignee: ITT Industries, Inc., New York, N.Y.

[21] Appl. No.: 883,870

[22] Filed: Mar. 6, 1978

[30] Foreign Application Priority Data

Mar. 4, 1977 [DE] Fed. Rep. of Germany ..... 2709433

[51] Int. Cl.[2] ..... H01R 43/06

[52] U.S. Cl. ..... 29/566; 29/597; 29/733; 72/358

[58] Field of Search ..... 29/733, 736, 597, 566, 29/33 R; 72/358, 359

[56] References Cited

U.S. PATENT DOCUMENTS

| | | | |
|---|---|---|---|
| 1,898,929 | 2/1933 | Apple | 29/597 |
| 3,708,872 | 1/1973 | Ohuchi et al. | 29/597 |
| 3,987,539 | 10/1976 | Gravener | 29/597 |

*Primary Examiner*—Carl E. Hall

*Attorney, Agent, or Firm*—William T. O'Neil

[57] ABSTRACT

Apparatus for manufacturing commutators, especially for small electric motors. Commutator segments are separately inserted into a mold intermediary plate. The segments are inelastically deformed by a coaxially inserted tool before the molding process. The formation of webs of the injected plastic body material between commutator segments is avoided.

4 Claims, 6 Drawing Figures

APPARATUS FOR MAKING A COMMUTATOR FOR AN ELECTRIC MOTOR

BACKGROUND OF THE INVENTION

This invention concerns apparatus and a method of making a commutator for relatively small electric motors, the segments of which are separately inserted into a mold intermediary plate during manufacture, filled with a plastic material, preferably a thermosetting plastic material.

Usually commutators consist of a cylindric body of plastic material to the circumference of which several segments are imbedded. In the finished form, such a commutator must have its segments (bars) separated from each other by slots which are not filled with the plastic body material. Otherwise, the plastic material normally used wears in the course of time and projecting plastic webs are formed between adjacent segments. This results in accelerated wear of the carbon brushes and in the generation of increased noise. Still more disadvantageous is the fact that such projecting plastic webs can produce brush contact dead spots so that if the motor is stopped in such a position in which a carbon brush springs back over these plastic webs, no brush contact is extant and the motor will not start. Thus, the formation of such plastic webs is detrimental to motor reliability and life. In the production of the individual segments in practice, tolerances as tight as ±0.02 mm between adjacent segments may be required. Even with such tight tolerances, thin plastic films can be created between the edges of individual adjacent segments and these films can have disadvantageous effects as described. Until now, manual removal of the films was required, preventing the automation of the process and consequent minimization of manufacturing costs. The manner in which the present invention provides an improved process and structure for commutator manufacture will be evident as this description proceeds.

SUMMARY

In view of the aforementioned prior art problems, the general object of the invention was the development of a method and apparatus by which such commutators could be automatically produced with accurate slots for air gaps along the commutator circumference at reasonable cost.

The problem is solved according to the invention in that the commutator segments in a mold intermediary plate emplaced and spaced about the commutator circumference are clamped by a tool in a way so that the edges of the segments are tightly fitted against separating webs radially extending into the inset. Those webs are part of the tooling, and upon their removal, accurate circumferential gaps between adjacent segments of the commutator are provided.

By this material deformation of the segments in the mold intermediary plate, the tolerances of the segments themselves and also the angular tolerances with respect to the adjustment of separating webs are fully compensated. In practice, the segments can even be produced with relatively loose tolerances and therefore more economically. In the process of the invention, automatic insertion of the segments into the mold intermediary plate is considerably facilitated.

It is imaginable in itself to effect the deformation and clamping of the segments with a tool having a radially extendable press die. Such a tool, however, is very expensive, and besides, it cannot be realized in fact if the size of the diameter of the commutator is only a few millimeters. Such a method may, therefore, be advantageously used only on commutators for larger motors, whereby the segments in radial direction are upset in such a way that their dimensions enlarge in the circumferential direction.

The deformation of the smaller segments according to an advantageous development of the invention is effected with a tool coaxially inserted into the mold intermediary plate. This tool can be wedge-shaped. In order to avoid the requirement for excessively high pressure, the die is preferably shaped in a manner that only the edge or edges of the segments are deformed. A deformation in the middle area of the segment is thus not necessary and, in fact, hardly possible if the known form of barbs are provided in the radially interior portion of the assembly for subsequent anchoring to the plastic body when the plastic material is introduced (injected).

In practice, one particular arrangement has proved particularly effective. In that arrangement, the segments are provided with longitudinally directed grooves without cutting action by the tool, whereby the segments are wedged over within the mold intermediary plate against the separating webs. During this kind of deformation, sealing beads are formed at the radially inner edge of the segments, whereas the outer edge does not necessarily rest against the separating webs.

The invention will be more fully understood as it is described hereinafter with reference to the drawings.

DETAIL DESCRIPTION

Figure 1:
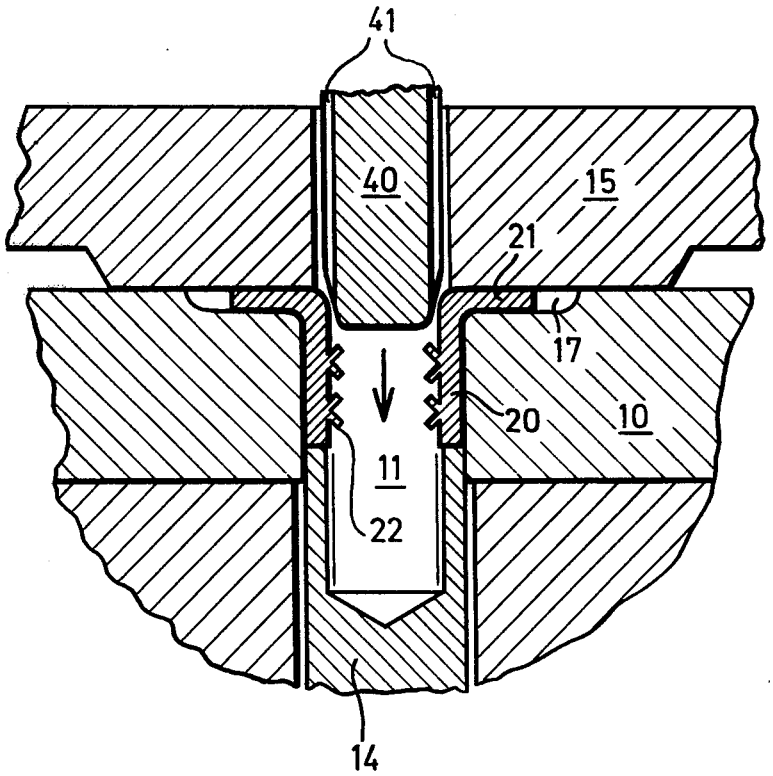
FIG. 1 is a longitudinal section through the mold and associated tooling carrying out the process.
Figure 2:
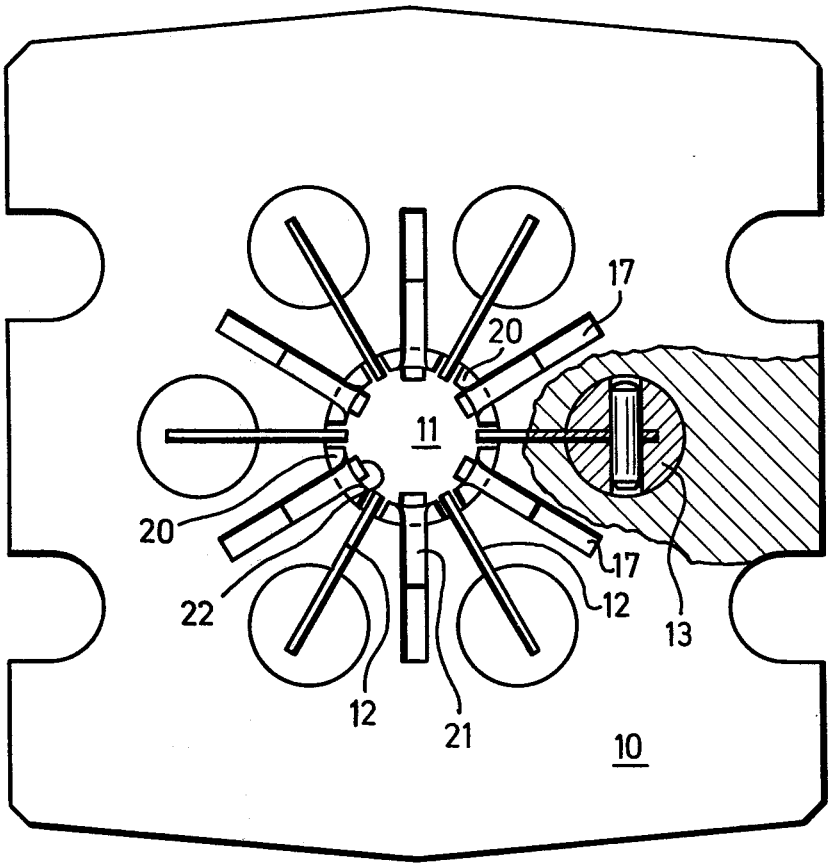
FIG. 2 is a top view of the intermediary mold plate with commutator segments in place but before completion of the process.

Referring now to FIGS. 1 and 2, it will be seen that the mold intermediary plate 10 has a cylindrical cavity 11 into which several separating webs 12 extend radially. These separating webs wear relatively quickly during the process and are, therefore, exchangeably mounted in the mold intermediary plate as this is indicated in 13.

A segment supporting bolt 14 is inserted into the bottom cylindrical cavity 11 of the mold intermediary plate as shown in FIG. 1. In FIG. 1, a pressure pad 15 grips the segment connection lugs 21 and thereby provides for an exact anchoring of the segments 20 in the mold intermediary plate during the process.

The segments 20 are of a basic material workable in cold state and each have a lug 21 for connection of the winding wires of the motor as well as barbs 22 providing anchoring of the segments in the plastic body of the commutator.

Figure 3:
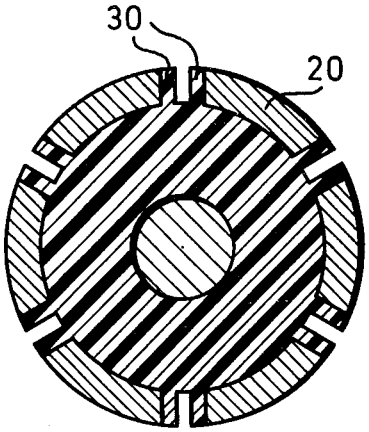
FIG. 3 is a section through a prior art commutator.
Figure 5:
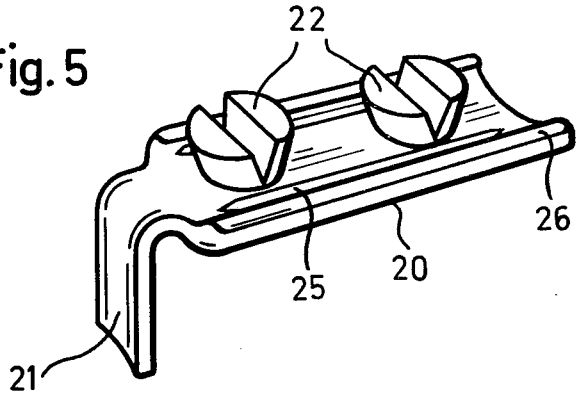
FIG. 5 is an individual commutator segment (bar) in perspective view.

The segments 20 are automatically inserted into the mold intermediary plate 10 in a way that their connecting lugs 21 are located in corresponding cavities 17 of the mold intermediary plate surface. As FIG. 2 shows, the circumferential width of each of the segments is less than the width in the clear between two adjacent webs 12. The reason for this is two-fold: on the one hand, tolerances of the segments 20, on the other hand providing for imperfect adjustment of the separating webs. If the cavity 11 of mold intermediary plate 10 would now be injection molded with plastic material in an injection molding tool between the edge of each segment and the neighboring separating web 12, plastic webs 30 would be formed as this is shown in FIG. 3. This would result in the described prior art disadvantageous effects.

Figure 4:
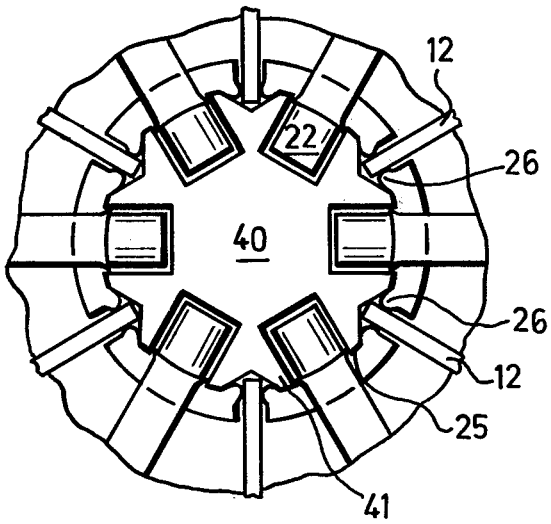
FIG. 4 is a view according to FIG. 2 after the process has been carried out.
Figure 6:
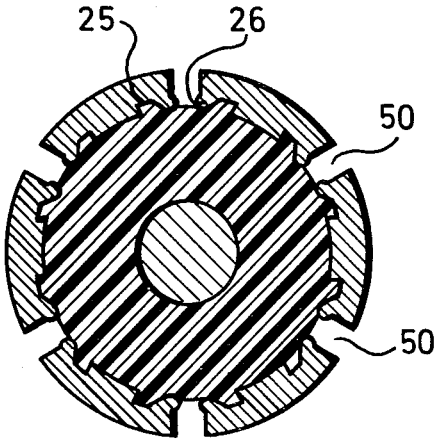
FIG. 6 is a section through a commutator produced in accordance with the invention.

In order to remedy the condition causing webs 30 of FIG. 3 (according to the invention) before the injection molding process, a die 40 having the outside contour shown in FIG. 4 is coaxially inserted into mold intermediary plate 10. This die 40 has a generally star-shaped perimeter including projections 41 at the circumferential spacing of the separating webs 12. As die 40 is inserted axially, it deforms the segment 20 without cutting action but with plastic flow of the material of the segments forming longitudinally directed grooves 25. Thereby the material at the edge of each segment is caused to flow so that a sealing bead 26 is formed which closely abuts the separating webs 12. As can be seen, especially from the FIGS. 4 and 6, only the inner edge of the segments 20 is deformed. Said segments, therefore, do not rest against the separating webs 12 along their entire lateral surface edges. By this deformation of the material of segments 20 in the mold intermediary plate 10, all tolerances are compensated, and flow of the plastic material forming the commutator body during the injection molding process (between the edge of the segments 20 and the separating webs 12) is prevented. The segments 20 of the completed commutator, as FIG. 6 shows, are separated from each other by clean air slots 50.

Conductive materials of appropriate ductility and otherwise suitable for the segments 20 are well known in this art.

The tooling used in the carrying out of the process according to the invention is made up of a rigid material not subject to rapid wear. A suitable material for the tool member such as the pressure plate, the intermediary mold plate, etc., would be one of the well known grades of tool steel. The thermosetting plastic material injected into the assembly as essentially the last step of the process may be selected from the available thermosetting plastic material commercially available and known for the type of use contemplated.

After these steps of the process are carried out, the mold intermediary plate 10 is inserted into an injection molding device. This injection molding device can be designed in a way that a commutator is produced as a separate part. It is, however, also possible to insert a motor shaft with a laminated armature core into said injection molding device, so that simultaneously with the production of the commutator, the complete armature unit is injection molded in one injection molding process, securing the commutator to the shaft in the correct location and assignment. After this injection molding process, only a moderate turning of the commutator perimeter will be necessary. In this manner, thus, a complete armature for an electric motor can be automatically produced at reasonable cost.

I claim:

1. Apparatus for the manufacture of electric motor armatures of generally cylindrical shape, including a body of plastic material with a plurality of commutator segments embedded in said plastic body, said segments extending axially along and being spaced circumferentially about the surface of said cylindrical shape, each of said segments having an angularly oriented electrical connection lug projecting from one end thereof, comprising:

first means including a mold intermediate plate having a cavity of circular cross-section through the thickness of said plate and a plurality of elongated grooves in a surface of said plate extending radially outward from the perimeter of said cavity, said grooves being spaced to receive said lugs of said segments, thereby locating said segments circumferentially about said cavity perimeter;

second means comprising a separating web extending radially inward within said cavity for a predetermined radial distance between each adjacent pair of said segments; and third means comprising a wedging tool having at least one axial ridge corresponding to each of said segments, for inelastically deforming each of said segments when axially inserted into said cavity and thereafter withdrawn to form a sealing bead on at least one adjacent segment edge adjacent to a separating web, said sealing bead acting to prevent flow of a subsequently injected hardenable plastic material in an initial fluid condition into the outer peripheral air gaps between adjacent segments.

2. Apparatus according to claim 1 in which said wedging tool has two of said ridges corresponding to each of said segments, said ridges being spaced to form a sealing bead along both edges of each of said segments, said sealing beads thereby seating on both sides against said separating webs.

3. Apparatus according to claim 1 in which a pressure plate is included for applying pressure against the surface of said intermediate plate containing said segment lugs in said elongated grooves to thereby clamp said segments in place prior to insertion of said tool, said pressure plate containing a clearance bore aligned with said intermediate plate, through which said tool may be inserted.

4. Apparatus according to claim 1 in which said plastic is a thermosetting material.

* * * * *